United States Patent [19]

Perego

[11] Patent Number: 5,071,149

[45] Date of Patent: Dec. 10, 1991

[54] GO-CART FOR CHILDREN

[75] Inventor: Gianluca Perego, Arcore, Italy

[73] Assignee: Peg Perego Pines S.p.A., Milan, Italy

[21] Appl. No.: 620,454

[22] Filed: Nov. 30, 1990

Related U.S. Application Data

[63] Continuation of Ser. No. 296,516, Jan. 12, 1989, abandoned.

[30] Foreign Application Priority Data

Jan. 22, 1988 [IT] Italy ..... 20496/88[U]

[51] Int. Cl.[5] ..... B62B 9/12

[52] U.S. Cl. ..... 280/87.051; 297/188; 108/26

[58] Field of Search ..... 280/87.01, 87.021, 87.041, 280/87.051, 33.993, 642, 647, 650, 658; 446/227; 297/188, 194, 153; 108/25, 26, 50; 248/499, 500, 359 R, 359 A, 359 C, 359 F, 359 G

[56] References Cited

U.S. PATENT DOCUMENTS

| | | | |
|---|---|---|---|
| 1,056,337 | 3/1913 | Hurlbut | 446/227 |
| 4,123,078 | 10/1978 | Marakami | 446/227 |
| 4,359,242 | 11/1982 | Gerken et al. | 280/87.051 |
| 4,540,219 | 9/1985 | Klinger | 446/227 |
| 4,576,392 | 3/1986 | Quinlan, Jr. | 280/87.051 |

*Primary Examiner*—Andres Kashnikow
*Assistant Examiner*—Richard Camby
*Attorney, Agent, or Firm*—McGlew & Tuttle

[57] ABSTRACT

A children's go-cart, or walker, comprises an annular base with wheels. The base is connected to a frame. A safety and support surface comprising a seat is mounted to the frame. The surface also provides, stably restrained thereto, a plurality of objects with which the child can play. The objects can be incorporated in a panel fixed in a removable manner to the surface.

2 Claims, 2 Drawing Sheets

GO-CART FOR CHILDREN

This is a file wrapper continuation application of application Ser. No. 296,516 filed Jan. 12, 1989 now abandoned.

FIELD AND BACKGROUND OF THE INVENTION

Go-carts, or walkers, for children are known, and one kind may consist structurally of an annular base with pivoting wheels on which base, a surface incorporating a seat, for supporting sundry objects and for the safety of the child, is mounted by means of a demountable frame.

When using the go-cart, the child always likes to have objects of various type to play with on the front portion of the tray of the surface, and these objects are inevitably dropped or knocked to the ground and have to be repeatedly collected-thus in most cases inconveniencing unnecessarily the person responsible for the child.

SUMMARY AND OBJECTS OF THE INVENTION

The overall object of the present invention is to obviate the aforesaid drawback by embodying a children's go-cart of the aforesaid kind, wherein the support surface stably incorporates a plurality of sundry objects with which the child can play and amuse itself.

The said objects can be of the widest variety of kinds; by way of non-limiting example a telephone, a clock, a key, a lever and a plurality of pushbuttons.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
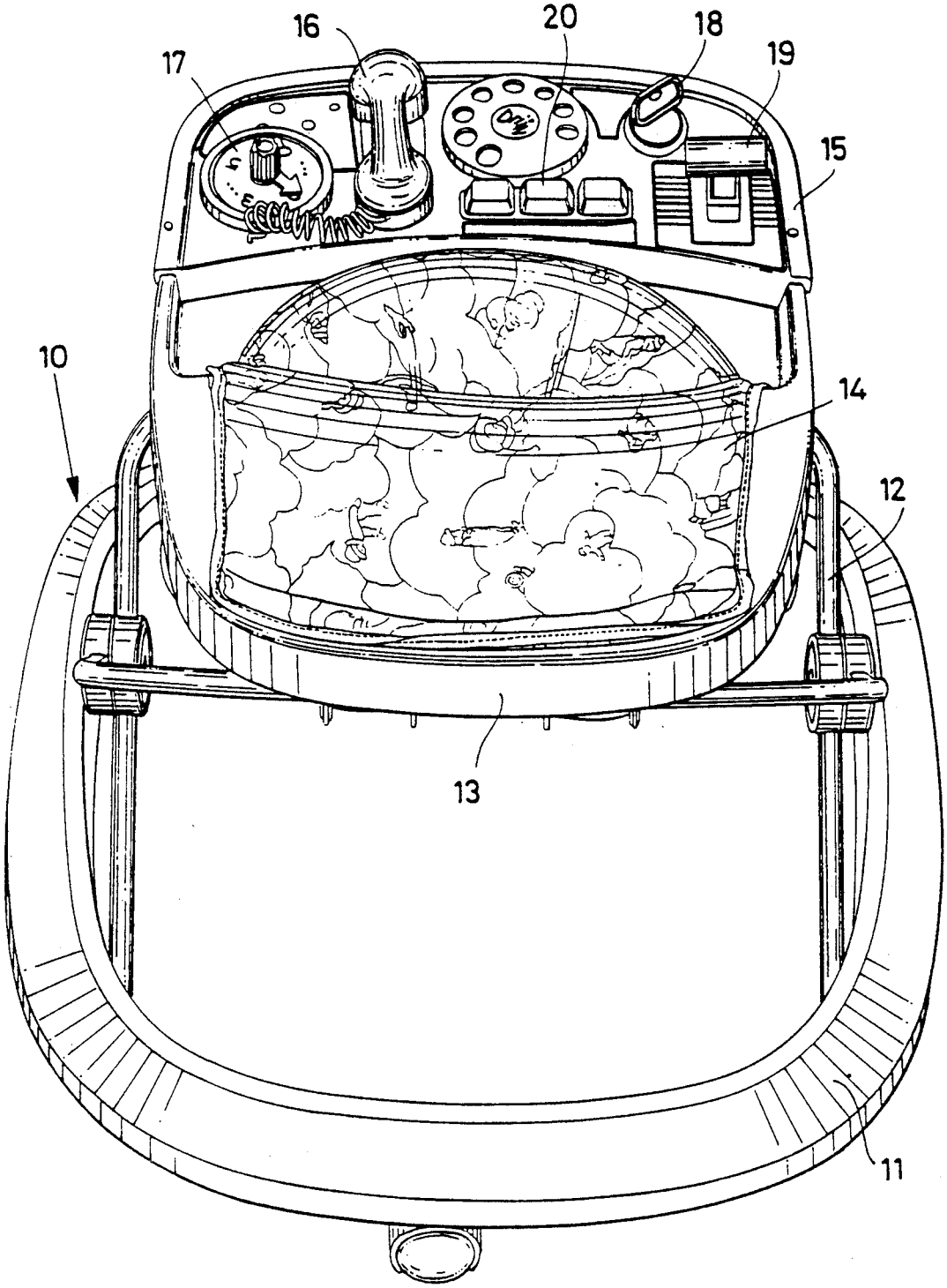
FIG. 1 is a top perspective view illustrating the go-cart embodied according to the invention.
Figure 2:
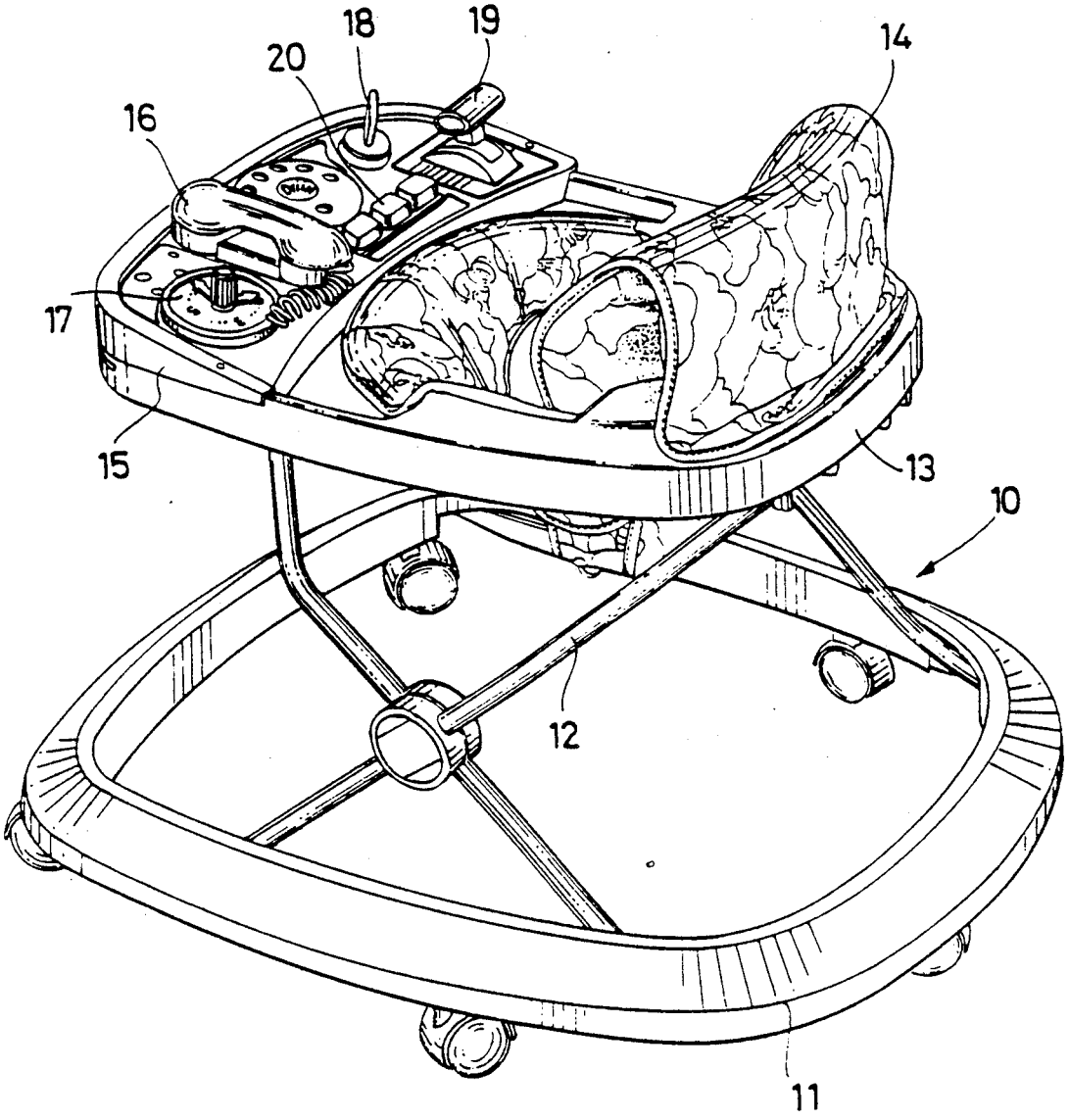
FIG. 2 is a side perspective view of the go-cart shown in FIG. 1.

With reference to the figures, the go-cart according to the invention is indicated overall by reference 10 and consists structurally of an annular base 11, with pivoting wheels, on which base, a surface 13 is mounted, by means of a demountable frame.

The surface 13 comprises a conventional seat 14 intended for the child to sit in and, in accordance with the present invention, a panel 15 incorporating in a stable manner a plurality of sundry objects with which the child can play is secured to the front part by securing means of the surface 13—for example by screws—a panel 15 incorporating in a stable manner a plurality of sundry objects with which the child can play.

In the non-limiting example shown in the figures, the said objects are a telephone 16, a clock 17, a key 18, a lever-grip 19 and a plurality of pushbuttons 20 and as shown in the figures, these objects may be wholly or partly embodied in the panel. Objects which are not formed by a single mold, with the panel, may be fixed to the panel during aswsembly of the panel.

Such objects can of course be different from those mentioned above, both as to type and as to number, without falling outside the scope of the present invention.

Same go-cart could in fact be equipped with several interchangeable panels 15, bearing different objects, so as to satisfy every play and cognitive requirement of the child.

The statements above show the utility of the go-cart according to the invention, the use of which does not permanent attendance with the child to pick up the plaything and objects that the child has dropped or thrown on the floor, as is the case with go-carts of the known kind.

I claim:

1. A children's walker comprising:

an annular base;

wheels connected to said annular base;

a frame member including a lower end connected to said annular base and an upper end;

a seat support surface including a seat support portion surrounding a seat and with a front support portion in front of said seat, said seat support surface being connected to said frame;

a panel connected to said seat support surface at a front part thereof, said panel including a plurality of toy elements, a portion of said toy elements being formed integral with said panel and a portion of said toy elements being fixedly connected to said panel; and connecting means for releasably connecting said panel to said seat support surface for replacing said panel with another panel having different toy objects formed therewith and connected thereto, said panel including a front part with a shaped surface with a channel conforming to said front support portion of said seat support surface, said channel of said panel engaging said front support position of said seat support surface for connecting said panel to said seat support surface, said toy elements on said panel including molded structures forming a unitary element with said toys and connected elements.

2. A children's walker, according to claim 1, wherein said objects includes a toy telephone; a toy clock; a toy key; a toy lever-grip and a plurality of toypushbuttons.

* * * * *